US009111711B2

(12) United States Patent
Ulisse et al.

(10) Patent No.: US 9,111,711 B2
(45) Date of Patent: Aug. 18, 2015

(54) ELECTRON-EMITTING COLD CATHODE DEVICE

(71) Applicant: SELEX ES S.P.A., Rome (IT)

(72) Inventors: Giacomo Ulisse, Rome (IT); Francesca Brunetti, Rome (IT); Aldo di Carlo, Rome (IT); Ferdinando Ricci, Rome (IT); Filippo Gemma, Rome (IT); Anna Maria Fiorello, Rome (IT); Massimiliano Dispenza, Rome (IT); Roberta Buttiglione, Rome (IT)

(73) Assignee: SELEX ES S.P.A., Rome (IT)

( * ) Notice: Subject to any disclaimer, the term of this patent is extended or adjusted under 35 U.S.C. 154(b) by 0 days.

(21) Appl. No.: 14/359,534

(22) PCT Filed: Nov. 26, 2012

(86) PCT No.: PCT/IB2012/056745

§ 371 (c)(1),
(2) Date: May 20, 2014

(87) PCT Pub. No.: WO2013/076709

PCT Pub. Date: May 30, 2013

(65) Prior Publication Data

US 2015/0022076 A1 Jan. 22, 2015

(30) Foreign Application Priority Data

Nov. 25, 2011 (IT) ..... TO2011A1088

(51) Int. Cl.
*H01J 19/24* (2006.01)
*H01J 1/304* (2006.01)
(Continued)

(52) U.S. Cl.
CPC ..... *H01J 19/24* (2013.01); *H01J 1/3042* (2013.01); *H01J 3/022* (2013.01); *H01J 9/025* (2013.01);
(Continued)

(58) Field of Classification Search
CPC ..... H01J 1/304; H01J 1/3042; H01J 1/3044; H01J 1/3046; H01J 19/24; H01J 19/46; H01J 19/32; H01J 19/38; H01J 3/022; H01J 21/105; H01J 21/20; H01J 9/025
See application file for complete search history.

(56) References Cited

U.S. PATENT DOCUMENTS 4,575,765 A 3/1986 Hirt
4,874,981 A * 10/1989 Spindt ..... 313/309
(Continued)

FOREIGN PATENT DOCUMENTS

EP 2113934 11/2009
WO WO 2009/084054 7/2009

OTHER PUBLICATIONS

Manohara: "Field emission testing of carbon nanotubes for THz frequency vacuum microtube sources"; Proceedings of SPIE, vol. 5343, Jan. 1, 2004, pp. 227-234, XP05503299, ISSN: 0277-786X, DOI: 10.1117/12.531403.
(Continued)

*Primary Examiner* — Anne Hines
(74) *Attorney, Agent, or Firm* — Dorsey & Whitney LLP

(57) ABSTRACT

One or more embodiments of the invention concern a device comprising: a cathode that lies on a cathode plane and includes, in an active region, one or more cathode straight-finger-shaped terminals with a main extension direction parallel to a first reference direction; for each cathode terminal, one or more electron emitters formed on, and in ohmic contact with, said cathode terminal; and a gate electrode that lies on a gate plane parallel to, and spaced apart from, said cathode plane, does not overlap the cathode and includes, in the active region, two or more gate straight-finger-shaped terminals with a main extension direction parallel to the first reference direction; wherein the gate terminals are interlaced with said cathode terminal(s).

15 Claims, 6 Drawing Sheets

(51) Int. Cl.

| | |
|---|---|
| ***H01J 9/02*** | (2006.01) |
| ***H01J 19/38*** | (2006.01) |
| ***H01J 21/10*** | (2006.01) |
| ***H01J 21/20*** | (2006.01) |
| ***H01J 3/02*** | (2006.01) |
| ***H01J 19/32*** | (2006.01) |
| ***H01J 19/46*** | (2006.01) |

(52) U.S. Cl.
CPC ..... *H01J 19/32* (2013.01); *H01J 19/38* (2013.01); *H01J 19/46* (2013.01); *H01J 21/105* (2013.01); *H01J 21/20* (2013.01)

(56) References Cited

U.S. PATENT DOCUMENTS

| | | | | |
|---|---|---|---|---|
| 5,268,648 | A | 12/1993 | Calcatera | |
| 5,445,550 | A * | 8/1995 | Xie et al. | 445/24 |
| 5,502,347 | A * | 3/1996 | Dworsky et al. | 313/309 |
| 5,528,098 | A * | 6/1996 | Dworsky et al. | 313/306 |
| 6,417,605 | B1 | 7/2002 | Hofmann et al. | |
| 2005/0057160 | A1 * | 3/2005 | Kim et al. | 315/59 |
| 2007/0018553 | A1 * | 1/2007 | Cho et al. | 313/311 |
| 2009/0072707 | A1 * | 3/2009 | Lee et al. | 313/496 |
| 2009/0181594 | A1 * | 7/2009 | Liu et al. | 445/58 |
| 2009/0195140 | A1 * | 8/2009 | Wei et al. | 313/307 |
| 2010/0045166 | A1 * | 2/2010 | Lee et al. | 313/496 |
| 2012/0169222 | A1 * | 7/2012 | Liu et al. | 313/506 |

OTHER PUBLICATIONS

International Search Report and Written Opinion from International Application No. PCT/IB2012/056745 mailed Mar. 27, 2013.

International Preliminary Report on Patentability from International Application No. PCT/IB2012/056745 mailed Jan. 31, 2014.

* cited by examiner

ELECTRON-EMITTING COLD CATHODE DEVICE

TECHNICAL FIELD OF INVENTION

The present invention relates, in general, to a micrometric/nanometric electronic device belonging to the family of semiconductor vacuum tubes for high-frequency applications and, in particular, to an electron-emitting cold cathode device for high-frequency applications. More specifically, the present invention concerns a cold-cathode triode and a cold-cathode electron gun.

STATE OF THE ART

As is known, technologies capable of operating at frequencies in the order of terahertz (THz) have been traditionally limited to the fields of molecular astronomy and chemical spectroscopy. However, recent advances in detectors and sources operating at frequencies in the THz band have opened the field to new applications, such as homeland security systems, measurement systems (network analysis and imaging), biological and medical applications (cell characterization, thermal and spectral mapping) and material characterization (near-field probing, food industry quality control and pharmaceutical quality control).

Although commercial uses for sensors and sources operating at THz band frequencies are growing, this growth is somehow limited by the difficulty of providing reliable sources operating at THz frequencies and for which traditional semiconductor technology has proven unsatisfactory, due to insufficient electron mobility.

The use of vacuum electronics instead of semiconductor technology allows the property of electrons to reach higher speeds in a vacuum than in a semiconductor material to be exploited and, in consequence, to achieve higher operating frequencies (nominally from GHz to THz). The general working principle of vacuum electronic devices is based on the interaction between a radio frequency (RF) signal and a generated electron beam; the RF signal imposes velocity modulation on the electrons in the electron beam, permitting an energy transfer from the electron beam to the RF signal.

Conventional old-generation vacuum tubes included thermionic cathodes for generating the electron beam, operating at very high temperatures (800° C.-1200° C.) and suffered from many limitations, among which: high electric power requirements, long heating-up time, instability problems and limited miniaturization.

The aforementioned limitations have been overcome with the introduction of vacuum devices with a FEA (Field Emission Array) cathode, which has led to significant advantages, in particular for frequency amplification in the THz band, enabling working at room temperature and achieving size reduction down to micrometric and nanometric dimensions. A FEA structure for RF sources was first proposed by Charles Spindt (C. A. Spindt et al., *Physical properties of thin-film field emission cathodes with molybdenum cones*, Journal of Applied Physics, vol. 47, December 1976, pages 5248-5263), and is usually referred to as the Spindt cathode (or cold cathode, due to the low operating temperature). In particular, Spindt cathode devices exploit micromachined metal electron emitter tips or cones formed on a conductive substrate and in ohmic contact therewith. Each emitter has its own concentric aperture in an acceleration field between an anode electrode and a cathode electrode. A gate electrode, also known as a control or modulation grid, is isolated from the anode and cathode electrodes and from the emitters by a silicon dioxide layer. Large arrays of electron emitter tips, each capable of producing several tens of microamperes, can theoretically produce large emission current densities.

The performance of Spindt cathode devices is limited by damage to the electron emitter tips due to material wear, and for this reason many efforts have been made around the world in searching for innovative materials for their production.

In particular, the Spindt structure has been greatly improved by using carbon nanotubes (CNTs) as cold cathode emitters (see, for example, S. Iijima, *Helical microtubules of graphitic carbon*, Nature, 1991, volume 354, pages 56-58, or W. Heer, A. Chatelain, D. Ugarte, *A carbon nanotube field-emission electron source*, Science, 1995, volume 270, issue 5239, pages 1179-1180).

Carbon nanotubes (CNT) are perfectly graphitized cylindrical tubes that can be produced with diameters ranging from approximately 2 to 100 nm and lengths of several microns, using various manufacturing processes.

In particular, CNTs can be considered as being among the best emitters in nature (see, for example, J. M. Bonard, J. P. Salvetat, T. Stockli, L. Forrò and A. Châtelain, *Field emission from carbon nanotubes: perspectives for applications and clues to the emission mechanism*, Applied Physics A, 1999, volume 69, pages 245-254), and therefore are ideal electron emitters in a Spindt-type device; many studies have already acknowledged their field emission properties (see, for example, S. Orlanducci, V. Sessa, M. L. Terranova, M. Rossi and D. Manno, Chinese Physics Letters, 2003, volume 367, pages 109-114).

Regarding this, FIG. 1 shows a schematic cross-sectional view of a known Spindt-type cold cathode device, in particular a Spindt-type cold-cathode triode, which uses the CNTs as electron emitters and which is indicated as a whole in FIG. 1 by reference numeral 1.

In particular, as shown in FIG. 1, the triode 1 comprises:

- a cathode structure 2;
- an anode electrode 3, spaced apart from the cathode structure 2 by means of lateral spacers 4; and
- a gate electrode 5, integrated in the cathode structure 2.

The cathode structure 2 with the integrated gate electrode 5 and the anode electrode 3 are formed separately and then bonded together with the interposition of the lateral spacers 4. The anode electrode 3 is made up of a first conductive substrate that functions as the anode of the triode device 1, while the cathode structure 2 is a multilayer structure that comprises:

- a second conductive substrate 7;
- a dielectric layer 8 arranged between the second conductive substrate 7 and the gate electrode 5;
- a recess 9 formed to penetrate the gate electrode 5 and the dielectric layer 8 so as to expose a surface of the second conductive substrate 7; and
- Spindt-type electron emitter tips 10 (only one electron emitter tip 10 is shown in FIG. 1 for simplicity of illustration), in particular, carbon nanotubes (CNT) or nanowires, formed in the recess 9 in ohmic contact with the second conductive substrate 7 and which function as the cathode of the triode device 1.

During operation, biasing the gate electrode 5 allows controlling the flow of electrons generated by the cathode structure 2 towards the node electrode 3 in the area corresponding to and surrounding the recess 9; the current thus generated is collected by the portion of the anode electrode 3 that is placed over the gate electrode 5.

In the triode 1, it is therefore possible to define:

- an active (or triode) area 1*a* that comprises a region corresponding to and tightly surrounding the electron emitter tips 10 and the recess 9 in which the which electrons are generated and collected; and a biasing area 1*b*, as the region external to the active area 1*a* through which biasing signals are conveyed to the active (triode) area 1*a*.

The topographical configuration of Spindt-type cold-cathode triodes, such as the triode 1 shown in FIG. 1 for example, suffers from an important limitation caused by high parasitic capacitances existing between the gate electrode and the cathode and anode electrodes. These parasitic capacitances heavily limit the operating frequencies that this type of device can reach, reducing the cut-off frequencies and rendering THz applications substantially unfeasible, even for micron-scaled structures.

In particular, these parasitic capacitances are due to the overlapping of the gate, cathode and anode electrodes.

A topographical configuration for vacuum devices with a Spindt-type FEA cathode that partially reduces the aforementioned parasitic capacitances is described by C. A. Spindt, C. E. Holland, A. Rosengreen and I. Brodie in *Field-emitter-array development for high-frequency operation*, Journal of Vacuum Science & Technology B: Microelectronics and Nanometer Structures, Volume 11, Issue 2, March 1993, pages 468-473. In particular, *Field-emitter-array development for high-frequency operation* describes a Spindt-type cold-cathode triode in which the cathode and gate electrodes only overlap in the active areas of the triode (regarding this, please refer specifically to FIGS. 2 and 4 of said article). The triode structure presented in Field-emitter-array development for high-frequency operation permits achieving operating frequencies in the order of gigahertz (GHz), while, because of the residual parasitic capacitances due to the overlapping of the cathode and gate electrodes in the active area, this triode structure does not allow frequencies in the THz band to be reached.

Furthermore, European Patent EP2223325 granted to the applicant also describes an innovative topographical configuration for Spindt-type cold-cathode triodes that enables the aforementioned parasitic capacitances to be reduced.

In particular, EP2223325 describes a triode, in particular for high-frequency applications, comprising a multilayer structure that includes:

a cathode electrode;

an anode electrode spaced apart from the cathode electrode;

a gate electrode placed between the anode electrode and the cathode electrode; and at least one electron emitter tip.

In detail, in the triode according to EP2223325, the cathode, gate and anode electrodes:

are formed in different layers of the multilayer structure to overlap in an active (or triode) area at the electron emitter tip and to cooperate with said electron emitter tip to generate an electron beam in said active area;

do not overlap outside of the active area; and each have a respective main extension direction along a respective line, wherein said respective lines lie on parallel planes and are each inclined at a non-zero angle with respect to all the others.

A second type of vacuum devices is the so-called electron gun. As is known, an electron gun is a device that produces an electron beam with precise kinetic energy and can be used:

in general, as a cathode-ray tube component for televisions and monitors, or in other instruments, such as, for example, electron microscopes and particle accelerators; and, in particular, for making vacuum amplifiers, such as travelling wave tube (TWT) amplifiers or Klystron vacuum tubes.

In general, an electron gun comprises:

a cathode structure;

a focusing grid placed around the cathode structure;

a collector spaced apart from the cathode structure; and an anode structure interposed between the cathode structure and the collector and comprising a hole that passes completely through it and that faces, at a first end, the cathode structure and, at a second end, the collector.

In use, the cathode structure generates an electron beam, the focusing grid focuses the electron beam generated by the cathode structure onto the hole of the anode structure, the anode structure accelerates and focuses the electron beam that passes through the hole still further due to a large potential difference with respect to the focusing grid, while the collector receives the flow of electrons that leaves the hole of the anode structure.

A modulation grid (or gate electrode) can be conveniently integrated into the cathode structure of an electron gun. In this way, the emitted current can be directly modulated by applying an RF signal on said modulation grid. Direct modulation of the emitted current has already been used on thermionic cathodes (see, for example, A. J. Lichtenberg, *Prebunched beam traveling wave tube studies*, IRE Trans. Electron Devices, 1962, vol. ED-9, pages 345-351), in this way obtaining advantages in terms of vacuum tube efficiency and gain. In particular, in *Prebunched beam traveling wave tube studies*, a 20% to 35% increase in the efficiency of a TWT amplifier by using a frequency-modulated thermionic cathode is described. Unfortunately, however, the modulation is limited to a maximum of 2 GHz in this type of vacuum tube because of the large distance between cathode and modulation grid.

Instead, by using cold cathodes, it is possible to go beyond the 2 GHz limit attainable with thermionic cathodes. In particular, the possibility of producing electron guns with directly modulated Spindt-type cold cathodes where it is possible to modulate the electron beam at frequencies above 2 GHz has been demonstrated in the past (see, for example, D. R. Whaley, B. M. Gannon, V. O. Heinen, K. E. Kreischer, C. E. Holland and C. A. Spindt, *Experimental Demonstration of an Emission-Gated Traveling-Wave Tube Amplifier*, IEEE TRANSACTIONS ON PLASMA SCIENCE, Vol. 30, No. 3, 2002).

European patent application EP 2 113 934 A2 describes an electron source for an image display apparatus in which the electron source comprises a plurality of electron emitter devices connected to a matrix wiring of scanning lines and modulation lines on a substrate.

In particular, according to EP 2 113 934 A2, each of the electron emitter devices comprises a cathode electrode connected to a scanning line, a gate electrode connected to a modulation line and a plurality of electron emitter members.

In detail, according to EP 2 113 934 A2, for each one of the electron emitter devices:

the cathode electrode has a first comb-like structure and is configured to apply a cathode potential to the plurality of electron emitter members;

the gate electrode has a second comb-like structure and is configured to apply a gate potential to the plurality of electron emitter members;

the first comb-like structure is equipped with a plurality of first comb-teeth and a first comb-handle part that connects the first comb-teeth to the scanning line;

the second comb-like structure is equipped with a plurality of second comb-teeth and a second comb-handle part that connects the second comb-teeth to the modulation line; and a connection electrode, electrically connected to the plurality of first or second comb-teeth.

The electron source described in EP 2 113 934 A2 has a very "angular" structure with many right angles. In this regard, reference can be made, for example, to FIGS. 3 and 5A of EP 2 113 934 A2, where it is possible to note:

the 90° angles between the comb-teeth of the cathode (indicated in FIG. 3 of EP 2 113 934 A2 by reference numerals 2a, 2b and 2c) and the comb-handle part of the cathode (indicated in FIG. 3 of EP 2 113 934 A2 by reference numeral 2d);

the 90° angles between the comb-teeth of the cathode and respective electrodes (indicated in FIG. 5A of EP 2 113 934 A2 by reference numerals 6A, 6B, 6C and 6D);

the 90° curvature of the comb-handle part of the cathode;

the 90° angle between the comb-handle part of the cathode and the scanning line (indicated in FIG. 3 of EP 2 113 934 A2 by reference numeral 32);

the 90° angles between the comb-teeth of the gate electrode (indicated in FIG. 3 of EP 2 113 934 A2 by reference numerals 5a, 5b and 5c) and the comb-handle part of the gate electrode (indicated in FIG. 3 of EP 2 113 934 A2 by reference numeral 5d);

the 90° angles between the comb-teeth of the gate electrode and respective electrodes (indicated in FIG. 5A of EP 2 113 934 A2 by reference numerals 90A, 90B, 90C and 90D); and the 90° angle between the comb-handle part of the gate electrode and the modulation line (indicated in FIG. 3 of EP 2 113 934 A2 by reference numeral 33).

The aforementioned angular structure severely limits the operating frequencies of the electron source described in EP 2 113 934 A2, effectively preventing frequencies in the THz band from being reached.

OBJECT AND SUMMARY OF THE INVENTION

The Applicant has carried out in-depth research for the purpose of developing a topographical configuration for electron-emitting cold cathode devices that enables, in general, the drawbacks of known electron-emitting cold cathode devices to be at least partially mitigated and, in particular, to increase the operating frequencies of electron-emitting cold cathode devices.

In detail, the applicant has carried out in-depth research for the purpose of developing a topographical configuration for electron-emitting cold cathode devices that:

if used to produce electron-emitting cold-cathode triodes, enables increasing the operating frequencies of these devices by at least partially reducing the parasitic capacitances, in particular the parasitic capacitances between the cathode electrode and the control grid, which severely limit the cut-off frequencies of the previously described Spindt-type cold-cathode triodes; and, if used to produce electron guns with a cold cathode electron emitter, enables increasing the operating frequencies of these devices.

The aforementioned object is achieved by the present invention insofar as it relates to an electron-emitting cold cathode device, as defined in the appended claims.

BRIEF DESCRIPTION OF DRAWINGS

For a better understanding of the present invention, some preferred embodiments, provided by way of non-limitative example, will now be described with reference to the attached drawings (not to scale), where.

DETAILED DESCRIPTION OF PREFERRED EMBODIMENTS OF THE INVENTION

Figure 1:
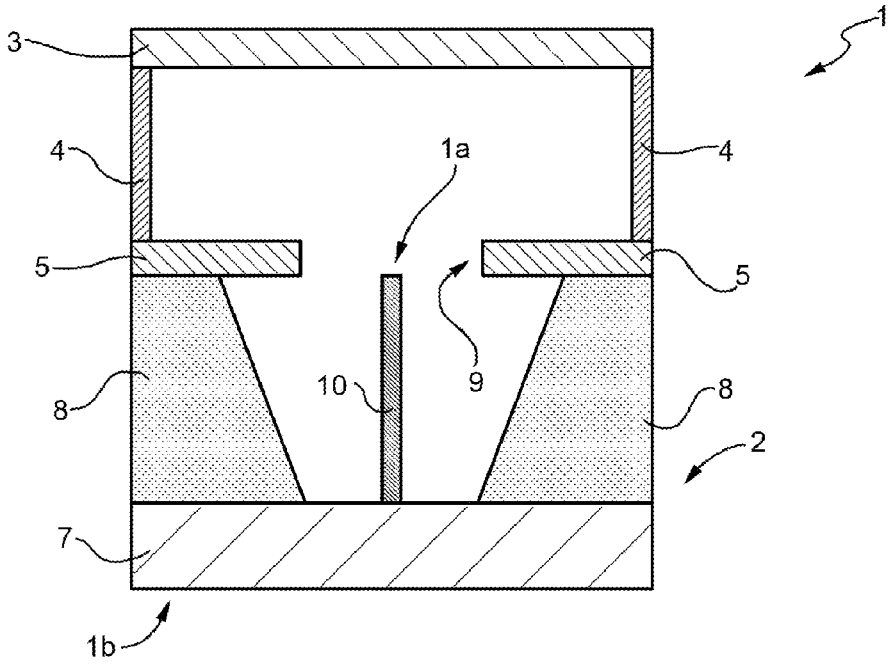
FIG. 1 shows a schematic cross-sectional view of a known Spindt-type cold-cathode triode with a carbon nanotube as electron emitter.

The following description is presented to enable a person skilled in the art to make and use the invention. Various modifications to the embodiments described will be readily apparent to those skilled in the art, and the generic principles herein may be applied to other embodiments and applications without, however, leaving the scope of protection of the present invention.

Thus, the present invention is not intended to be limited to the embodiments shown, but is to be accorded the widest scope consistent with the principles and features disclosed herein and defined in the appended claims.

In general, the present invention relates to an electron-emitting cold cathode device.

In particular, the electron-emitting cold cathode device according to the present invention comprises:

a cathode electrode that lies on a cathode plane and includes, in an active region of the device, a cathode fingered structure comprising one or more cathode straight-finger-shaped terminal(s), each with a respective main extension direction parallel to a first reference direction (which is parallel to the cathode plane);

for each cathode straight-finger-shaped terminal, one or more respective electron emitter(s) formed on, and in ohmic contact with, said cathode straight-finger-shaped terminal; each electron emitter having a respective main extension direction perpendicular to the cathode plane; and a gate electrode that lies on a gate plane parallel to, and spaced apart from, said cathode plane, does not overlap the cathode electrode and includes, in an active region of the device, a gate fingered structure comprising two or more gate straight-finger-shaped terminals, each with a respective main extension direction parallel to the first reference direction (which, from what has just been described, is also parallel to the gate plane); said gate straight-finger-shaped terminals being interlaced, preferably interfingered, with said cathode straight-finger-shaped terminal(s) and being designed to modulate an electron beam emitted, in use, by said electron emitter(s).

Preferably, the cathode electrode also comprises a cathode conduction line that is (directly or indirectly) connected to the cathode fingered structure, has a straight-strip-like shape with a main extension direction parallel to the first reference direction and is symmetrical with respect to an axis of symmetry of the cathode parallel to the first, reference direction. Furthermore, the cathode fingered structure is also symmetrical with respect to said axis of symmetry of the cathode.

Again preferably, the gate electrode also comprises a gate conduction line that is (directly or indirectly) connected to the gate fingered structure, has a straight-strip-like shape with a main extension direction parallel to the first reference direction and is symmetrical with respect to an axis of symmetry of the gate parallel to the first reference direction. Furthermore, the gate fingered structure is also symmetrical with respect to said axis of symmetry of the gate.

Conveniently, for each cathode straight-finger-shaped terminal, the respective electron emitter(s) is/are substantially median with respect to said cathode straight-finger-shaped terminal, in particular the electron emitter(s) is/are placed in position(s) that is/are substantially median with respect to said cathode straight-finger-shaped terminal, precision of the manufacturing technology permitting.

Still more conveniently, each cathode straight-finger-shaped terminal is contained between two gate straight-finger-shaped terminals and, for each cathode straight-finger-shaped terminal, the respective electron emitter(s) is/are substantially median with respect to the two adjacent gate straight-finger-shaped terminals.

The present invention enables increasing the operating frequencies of electron-emitting cold cathode devices. In particular, the present invention enables producing electron-emitting cold cathode devices capable of operating at THz frequencies.

A first preferred embodiment of the present invention relates to a triode with a cold-cathode electron emitter.

Figure 2:
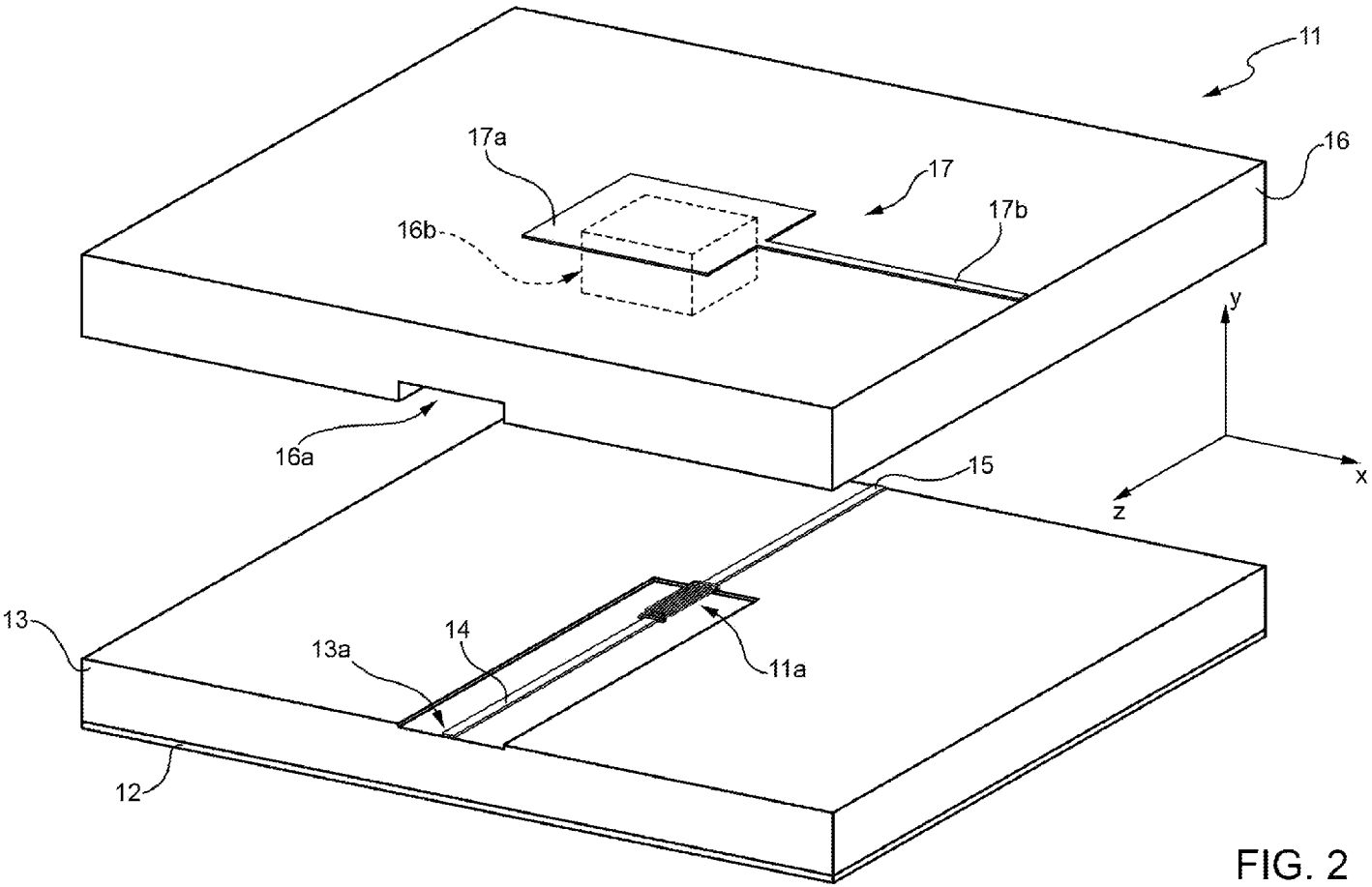
FIG. 2 shows a perspective view of a cold-cathode triode electron emitter according to a first preferred embodiment of the present invention.

With regard to this, in FIG. 2 (where the dimensions shown are not to scale for simplicity of illustration) a perspective view is shown of a cold-cathode triode 11 according to said first preferred embodiment of the present invention.

In particular, the cold-cathode triode 11 comprises:

an electrically conductive layer 12, for example made of metal, designed to function as a ground plane of the triode to carry high-frequency signals on the cathode and gate conduction lines, which will be introduced and described in detail hereinafter;

a first electrically insulating substrate 13 placed, for example by deposition, on the electrically conductive layer 12 (preferably, the electrically conductive layer 12 is formed on the lower surface of the first electrically insulating substrate 13 during manufacture of the cold-cathode triode 11);

a first recess 13*a* formed on the first electrically insulating substrate 13 to define two offset top surfaces on the latter, i.e. lying on two different planes that are substantially parallel to the ground plane 12; in particular, said offset top surfaces comprise a first and a second top surface that, as just explained, are substantially parallel to the ground plane 12; the first top surface being recessed, or lowered, with respect to the second top surface that, consequently, is raised with respect to said first top surface;

a cathode electrode 14 formed, for example by deposition, on the first electrically insulating substrate 13 inside the first recess 13*a* to partially cover the first top surface, i.e. the recessed top surface of the first electrically insulating substrate 13;

a gate electrode (or control grid or modulation grid) formed, for example by deposition, on the first electrically insulating substrate 13 external to the first recess 13*a* so as to partially cover the second top surface, i.e. the raised top surface of the first electrically insulating substrate 13;

a second electrically insulating dielectric substrate 16, which comprises a second recess 16*a* that passes longitudinally and completely along a lower surface of said second electrically insulating substrate 16, and a third recess 16*b* that passes vertically through all of said second electrically insulating substrate 16, starting from a top surface of said second electrically insulating substrate 16 and arriving, to the second recess 16*a*; said second electrically insulating substrate 16 being bonded onto the first electrically insulating substrate 13 so that the second recess 16*a* opens onto top portions of the first electrically insulating substrate 13 on which the cathode electrode 14 and gate electrode 15 are formed, and the third recess 16*b* opens onto an active (or triode) region 11*a* of the triode 11; said second electrically insulating substrate 16 being bonded onto the first electrically insulating substrate 13 by using vacuum bonding techniques so that a vacuum is present inside the second recess 16*a* and the third recess 16*b* (in FIG. 2, the second electrically insulating substrate 16 is shown separated from the first electrically insulating substrate 13 for clarity of illustration); and an anode electrode 17 formed, for example by deposition, on the second electrically insulating substrate 16 to partially cover the top surface and comprising an anode terminal 17*a* that closes the top of the third recess 16*b* and an anode conduction line 17*b* connected to said anode terminal 17*a*.

In order to describe said first preferred embodiment of the present invention in detail, in addition to FIG. 2, reference will hereinafter be made to FIG. 3 as well, in which a perspective view is shown of the active region 11*a* of the cold-cathode triode 11, where the same reference numerals indicate the same elements shown in FIG. 2 and previously described, and where the dimensions shown are not to scale for simplicity of illustration.

Figure 3:
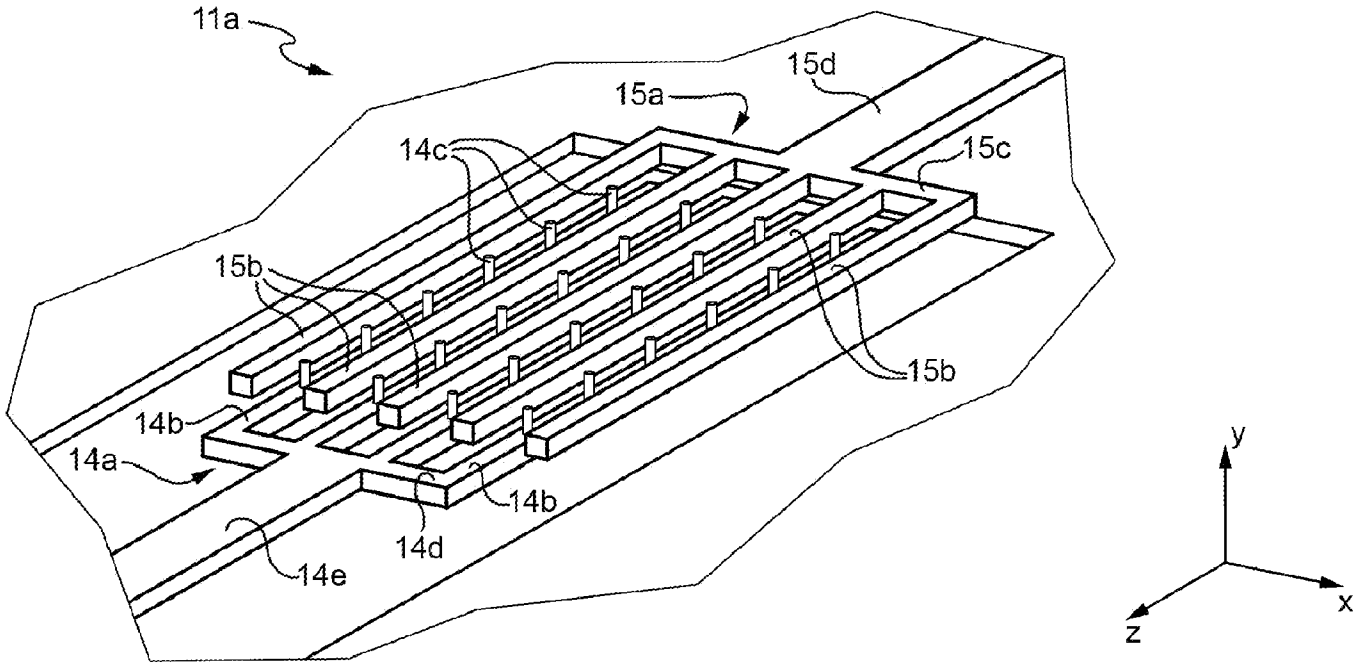
FIG. 3 shows a perspective view of an active region of the triode in FIG. 2.

In particular, as shown in FIG. 3, the cathode electrode 14, which is designed to emit electrons in the direction of the anode electrode 17, in particular towards the anode terminal 17*a*, is formed on a portion of the recessed top surface of the first electrically insulating substrate 13 and comprises:

a cathode multi-fingered structure 14*a*, which is formed at the active region 11*a* and comprises a plurality of cathode straight-finger-shaped terminals 14*b*; each cathode straight-finger-shaped terminal 14*b* having a respective main extension direction; all the respective main extension directions of the cathode straight-finger-shaped terminals 14*b* being parallel to a same first reference direction z, which is parallel to the ground plane 12 and which hereinafter, for simplicity of description, will be called the longitudinal reference direction;

for each cathode straight-finger-shaped terminal 14*b*, a plurality of respective electron emitters 14*c*, such as, for example, molybdenum microtips or carbon nanotubes (CNT) or nanowires, which have nanometric diameters and are formed on, and in ohmic contact with, said cathode straight-finger-shaped terminal 14*b*; each electron emitter 14*c* extending vertically from the respective cathode straight-finger-shaped terminal 14*b* along a respective main extension direction that is parallel to a second reference direction y, which is orthogonal to the longitudinal reference direction z and the ground plane 12 and which hereinafter, for simplicity of description, will be called the vertical reference direction;

a cathode backbone line 14*d* that is connected to the cathode multi-fingered structure 14*a* and extends laterally from the cathode straight-finger-shaped terminals 14*b*; said cathode backbone line 14*d* having a straight-strip-like shape with a main extension direction that is parallel to a third reference direction x, which is orthogonal to the longitudinal reference direction z and the vertical reference direction y and parallel to the ground plane 12 and which hereinafter, for simplicity of description, will be called the transversal reference direction; and a cathode conduction line 14*e* that is connected to the cathode backbone line 14*d* and is designed to carry the power supply and high-frequency signals from outside the active area 11*a* and through the cathode backbone line 14*d* to the cathode straight-finger-shaped terminals 14*b* to drive the electron emitters 14*c*; said cathode conduction line 14*e* extending laterally from the cathode backbone line 14*d* on the opposite side with respect to that from which the cathode straight-finger-shaped terminals 14*b* extend; said cathode conduction line 14*e* having a straight-strip-like shape with a main extension direction parallel to the longitudinal reference direction z.

In other words, the cathode electrode 14 has a rake-like shape, in which the cathode straight-finger-shaped terminals 14*b* are the rake teeth, the cathode backbone line 14*d* is the base of the rake from which said teeth extend and the cathode conduction line 14*e* is the rake handle that extends from said base.

The cathode conduction line 14*e* can be conveniently placed on and along an axis of symmetry of the cathode backbone line 14*d* that is parallel to the longitudinal reference direction z, and the cathode multi-fingered structure 14*a* can conveniently be symmetrical with respect to said axis of symmetry of the cathode backbone line 14*d*.

Hereinafter, the cathode straight-finger-shaped terminals 14*b* will be called cathode fingers for simplicity of description.

According to an alternative embodiment of the cathode electrode 14 (not shown in the attached figures), the cathode backbone line 14*d* may not be present and the cathode fingers 14*b* can protrude, or rather extend, directly from one end of the cathode conduction line 14*e*. According to this alternative embodiment of the cathode electrode 14, the cathode multi-fingered structure 14*a* can conveniently be symmetrical with respect to an axis of symmetry of the cathode conduction line 14*e* that is parallel to the longitudinal reference direction z.

Furthermore, always with reference to that shown in FIG. 3, the gate electrode 15, which is designed to control, or modulate, the flow of electrons between the electron emitters 14*c* and the anode terminal 17*a*, is formed on a portion of the raised top surface of the first electrically insulating substrate 13 and comprises:

a gate multi-fingered structure 15*a*, which is formed on the active region 11*a* and comprises a plurality of gate straight-finger-shaped terminals 15*b* that are interlaced, in particular interfingered, or interwoven, with the cathode straight-finger-shaped terminals 14*b* such that each cathode straight-finger-shaped terminal 14*b* is contained between two gate straight-finger-shaped terminals 15*b*; each gate straight-finger-shaped terminal 15*b* having a respective main extension direction that is parallel to the longitudinal reference direction z;

a gate backbone line 15*c*, which is connected to the gate multi-fingered structure 15*a* and extends laterally from the gate straight-finger-shaped terminals 15*b*; said gate backbone line 15*c* having a straight-strip-like shape with a main extension direction that is parallel to the transversal reference direction x; and a gate conduction line 15*d* that is connected to the gate backbone line 15*c* and is designed to carry the power supply and high-frequency signals from outside the active area 11*a* and through the gate backbone line 15*c* to the gate straight-finger-shaped terminals 15*b* to drive them; said gate conduction line 15*d* extending laterally from the gate backbone line 15*c* on the opposite side with respect to that from which the gate straight-finger-shaped terminals 15*b* extend; said gate conduction line 15*d* having a straight-strip-like shape with a main extension direction parallel to the longitudinal reference direction z.

In other words, the gate electrode 15 has a rake-like shape in which the gate straight-finger-shaped terminals 15*b* are the rake teeth, the gate backbone line 15*c* is the base of the rake from which said teeth extend and the gate conduction line 15*d* is the rake handle that extends from said base in the opposite direction to that of the extension of the cathode electrode 14.

The gate conduction line 15*d* can be conveniently placed on and along the axis of symmetry of the gate backbone line 15*c* that is parallel to the longitudinal reference direction z, and the gate multi-fingered structure 15*a* can conveniently be symmetrical with respect to said axis of symmetry of the gate backbone line 15*c*.

Hereinafter, the gate straight-finger-shaped terminals 15*b* will be called gate fingers for simplicity of description.

According to an alternative embodiment of the gate electrode 15 (not shown in the attached figures), the gate backbone line 15*c* may not be present and the gate fingers 15*b* can protrude, or rather extend, directly from one end of the gate conduction line 15*d*. According to this alternative embodiment of the gate electrode 15, the gate multi-fingered structure 15*a* can conveniently be symmetrical with respect to an axis of symmetry of the gate conduction line 15*d* that is parallel to the longitudinal reference direction z.

It is important to note that, although arranged on different, or rather on offset planes, the cathode fingers 14*b* and gate fingers 15*b* are mutually interlaced, in particular interfingered, that the cathode electrode 14 and gate electrode 15 do not overlap in any region of the triode 11, that, specifically, the cathode fingers 14*b* and gate fingers 15*b* are interlaced in the active region 11*a* and therefore not overlapping, and that the cathode conduction line 14*e* and gate conduction line 15*d* have opposite respective main extension directions that (if projected onto any reference plane parallel to the ground plane 12) form an angle of 180° between them.

Thanks to the fact that the cathode electrode 14 and gate electrode 15 are not overlapping, in particular thanks to the fact that in the active region 11*a*, the cathode fingers 14*b* and gate fingers 15*b* are not overlapping, parasitic capacitances between the cathode electrode 14 and gate electrode 15 are significantly reduced, or even completely eliminated.

Furthermore, the geometry of the cathode electrode 14 and the gate electrode 15 makes the manufacturing process of these electrodes extremely simple and easily reproducible.

In order to continue with the detailed description of said first preferred embodiment of the present invention, in addition to FIGS. 2 and 3, reference will hereinafter also be made to FIG. 4, in which a schematic top view is shown of a portion of just the first electrically insulating substrate before the cathode 14 and gate 15 contacts are formed, where the same reference numerals indicate the same elements shown in FIGS. 2 and 3 and previously described, and where the dimensions shown are not to scale for simplicity of illustration.

Figure 4:
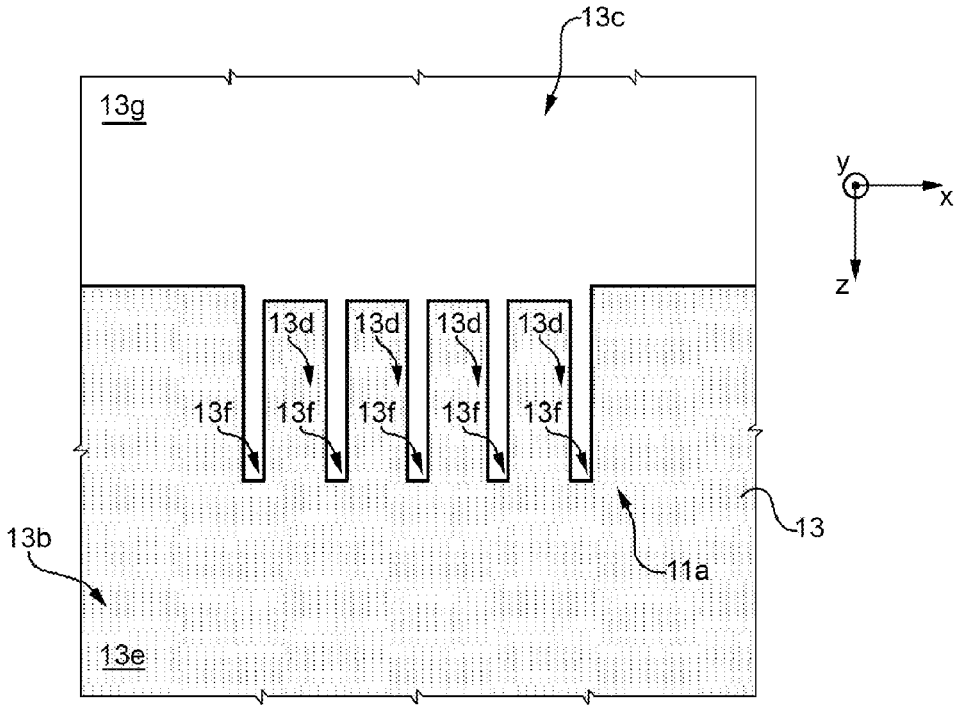
FIG. 4 shows a schematic top view of a first specific portion of the triode in FIG. 2.

In particular, FIG. 4 partially shows:

the first top surface, or rather the recessed top surface, of the first electrically insulating substrate 13, defined by the first recess 13*a* and indicated as a whole by reference numeral 13*b*; and the second top surface, or rather the raised top surface, of the first electrically insulating substrate 13, indicated as a whole by reference numeral 13*c*.

In detail, the raised top surface 13*c* comprises:

a plurality of first raised areas 13*f* substantially parallel to the ground plane 12, formed at the active region 11*a* and each having a respective straight-finger-like shape, thereby defining a multi-fingered raised surface; each first raised area 13*f* having a respective main extension direction parallel to the longitudinal reference direction z; and a second raised area 13*g*, which is substantially parallel to the ground plane 12 and extends laterally from the first raised areas 13*f*.

The multi-fingered raised surface can conveniently be symmetrical with respect to an axis of symmetry of the second raised area 13*g* that is parallel to the longitudinal reference direction z.

In addition, the recessed top surface 13*b* comprises:

a plurality of first recessed areas 13*d* substantially parallel to the ground plane 12, formed at the active region 11*a* and each having a respective straight-finger-like shape, in this way defining a multi-fingered recessed surface; each first recessed area 13*d* having a respective main extension direction parallel to the longitudinal reference direction z; said first recessed areas 13*d*, although on different planes, being interlaced, in particular interfingered, with the first raised areas 13*f* such that each first recessed area 13*d* is contained between two first raised areas 13*f*; and a second recessed area 13*e*, which is substantially parallel to the ground plane 12 and extends laterally from the first recessed areas 13*d*, from the first raised areas 13*f* and from the second raised area 13*g*.

The multi-fingered recessed surface can conveniently be symmetrical with respect to an axis of symmetry of the second recessed area 13*e* that is parallel to the longitudinal reference direction z.

In order to continue with the detailed description of said first preferred embodiment of the present invention, in addition to FIGS. 2-4, reference will hereinafter also be made to FIGS. 5, 6 and 7, where the same reference numerals indicate the same elements shown in FIGS. 2-4 and previously described, and where the dimensions shown are not to scale for simplicity of illustration.

Figure 5:
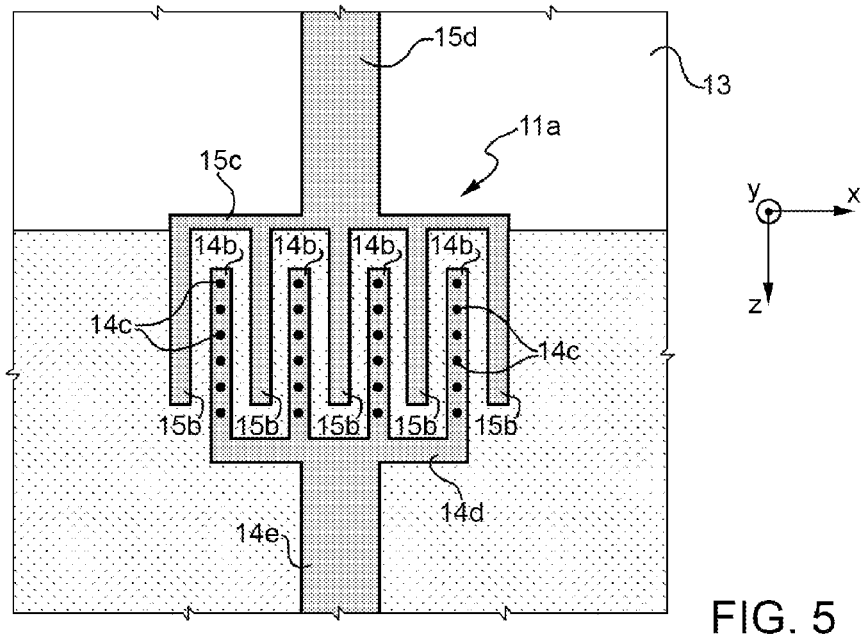
FIG. 5 shows a schematic top view of second specific portions of the triode in FIG. 2.
Figure 6:
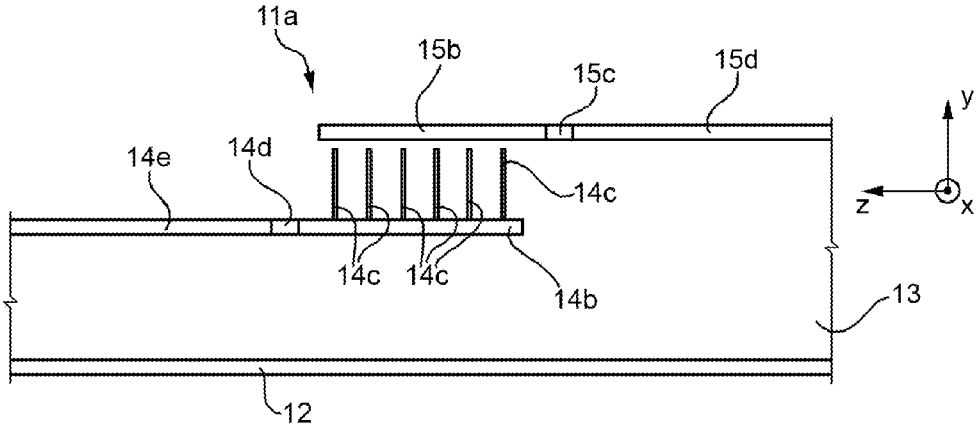
FIG. 6 shows a schematic, longitudinal sectional view of the second specific portions of the triode shown in FIG. 5.
Figure 7:
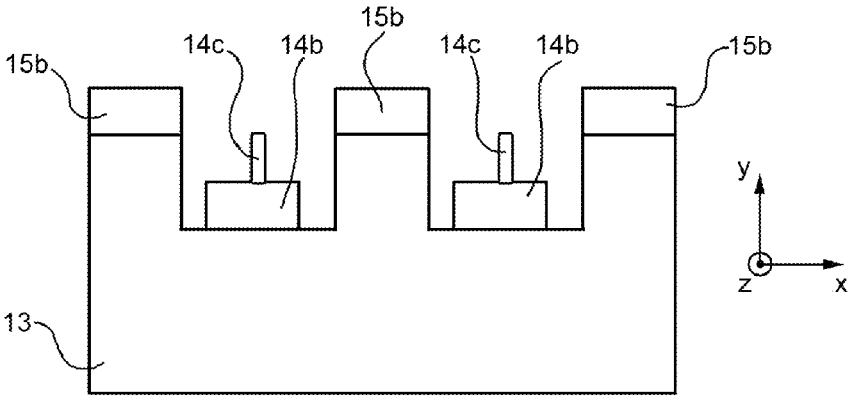
FIG. 7 shows a schematic cross-sectional view of a portion of the active region of the triode shown in FIG. 3.

In particular, FIGS. 5 and 6 respectively show a schematic top view and a schematic, longitudinal sectional view of a portion of the first electrically insulating substrate 13 on which the cathode 14 and gate 15 contacts are formed, and FIG. 7 shows a schematic cross-sectional view of a portion of the active region 11*a*.

In detail, as shown in FIGS. 2-7, the cathode multi-fingered structure 14*a* is formed on the multi-fingered recessed surface at the active region 11*a* and, specifically:

each cathode finger 14*b* is formed on a portion of a respective first recessed area 13*d;* the cathode backbone line is formed on a first portion of the second recessed area 13*e*, extending laterally from the first recessed areas 13*d* so that said cathode backbone line 14*d* extends laterally from the cathode fingers 14*b*; and the cathode conduction line 14*e* is formed on a second portion of the second recessed area 13*e* extending laterally from the first portion on the opposite side with respect to that from which the first recessed areas 13*d* extend, so that said cathode conduction line 14*e* extends laterally from the cathode backbone line 14*d* on the opposite side with respect to that from which the cathode fingers 14*b* extend.

In addition, always with reference to that shown in FIGS. 2-7, the gate multi-fingered structure 15*a* is also formed on the multi-fingered raised surface at the active region 11*a* and, specifically:

each gate finger 15*b* is formed on a respective first raised area 13*f* such that the gate fingers 15*b* are interlaced with the cathode fingers 14*b* and each cathode finger 14*b* is contained between two gate fingers 15*b;* the gate backbone line 15*c* is formed on a first portion of the second raised area 13*g*, extending laterally from the first raised areas 13*f* such that said gate backbone line 15*c* extends laterally from the gate fingers 15*b*; and the gate conduction line is formed on a second portion of the second raised area 13*g*, extending laterally from the first portion on the opposite side with respect to that from which the first raised areas 13*f* extend, so that said gate conduction line 15*d* extends laterally from the gate backbone line 15*c* on the opposite side with respect to that from which the gate fingers 15*b* extend.

In order to continue with the detailed description of said first preferred embodiment of the present invention, in addition to FIGS. 2-7, reference will hereinafter also be made to FIGS. 8 and 9, where the same reference numerals indicate the same elements shown in FIGS. 2-7 and previously described, and where the dimensions shown are not to scale for simplicity of illustration.

Figure 8:
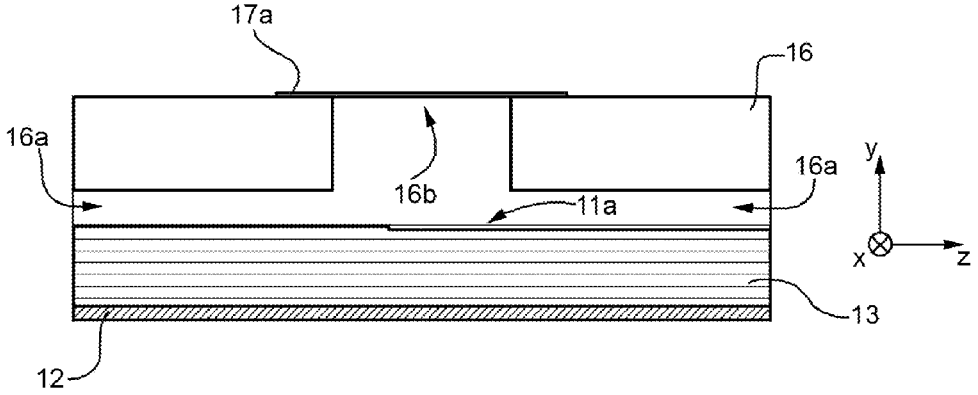
FIG. 8 shows a schematic, longitudinal sectional view of the triode in FIG. 2.
Figure 9:
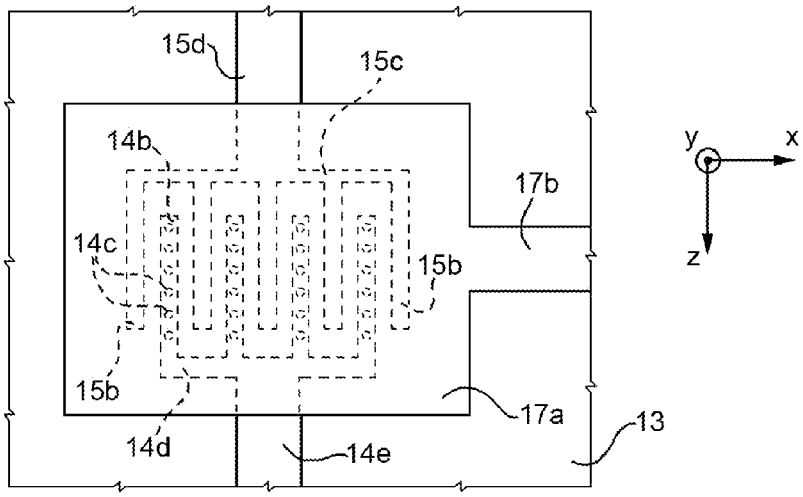
FIG. 9 shows a schematic top view of a third specific portion of the triode in FIG. 2.

In particular, FIG. 8 shows a schematic, longitudinal sectional view of the triode 11, while FIG. 9 shows a perspective top view of a central portion of the triode 11.

In detail, the second recess 16*a*, which has a main extension dimension parallel to the longitudinal reference direction z, longitudinally crosses the entire lower surface of the second electrically insulating substrate 16, preferably so as to divide said lower surface into two equal and symmetrical portions, i.e. so as to define, an axis of symmetry of said lower surface of the second electrically insulating substrate 16 that is parallel to the longitudinal reference direction z.

The third recess 16*b*, which has a main extension dimension parallel to the vertical reference direction y, vertically crosses the entire second electrically insulating substrate 16, starting from the second recess 16*a* and arriving to the top surface of said second electrically insulating substrate 16. Preferably, the third recess 16*b* is positioned at, and consequently passes vertically through, a central region of the second electrically insulating substrate 16.

The second electrically insulating substrate 16 is bonded onto the first electrically insulating substrate 13, using vacuum bonding techniques, in order to maintain electrical insulation in the middle. Preferably, the second electrically insulating substrate 16 is bonded to the first electrically insulating substrate 13 using standard wafer-to-wafer vacuum bonding techniques, such as anodic bonding, glass frit bonding, eutectic bonding, solder bonding, reactive bonding or fusion bonding.

Specifically, the second electrically insulating substrate 16 is bonded onto the first electrically insulating substrate 13 so that:

the second recess 16*a* encapsulates the cathode electrode 14 and gate electrode 15 so as to have a vacuum above the cathode conduction line 14*e* and gate conduction line 15*d* so that they can conduct high-frequency signals; and the third recess 16*b* is placed at the active region 11*a* so that said active region 11*a* faces the anode terminal 17*a* that closes the top of said third recess 16*b*, in order to enable the anode terminal 17*a* to receive the electrons emitted by the electron emitters 14*c*.

In addition, the anode electrode 17 comprises:

the anode terminal 17*a*, which closes the top of the third recess 16*b*, is designed to receive the electrons emitted by the electron emitters 14*c* through the third recess 16*b*, has a substantially rectangular or square shape and is substantially parallel to the ground plane 12; and the anode conduction line 17*b*, connected to the anode terminal 17*a*; in particular, said anode conduction line 17*b*, by extending laterally from the anode terminal 17*a* and having a strip-like shape with a main extension direction that is parallel to the transversal reference direction x, or rather that, with each of the main extension directions of the cathode conduction line 14*e* and gate conduction line 15*d*, forms (if said directions are projected onto any reference plane parallel to the ground plane 12) a respective 90° angle, is able to reduce possible coupling of high-frequency signals between the various electrodes.

It is important to note that the anode electrode 17 only partially overlaps the cathode electrode 14 and gate electrode 15. Specifically, the anode terminal 17*a* is placed over the cathode fingers 14*b*, gate fingers 15*b*, cathode backbone line 14*d* and gate backbone line 15*c* and just partially overlaps the cathode conduction line 14*e* and gate conduction line 15*d*, while the anode conduction line 17*b* overlaps neither the cathode electrode 14 nor the gate electrode 15.

Thanks to the fact that the anode electrode 17 only partially overlaps the cathode electrode 14 and gate electrode 15, parasitic capacitances are also significantly reduced between the anode electrode 17 and the cathode electrode 14 and gate electrode 15.

Furthermore, the geometry of the anode electrode 17 makes the manufacturing process of this electrode extremely simple and easily reproducible.

With regard to the size of the triode 11 described so far, said triode 11 can conveniently have the dimensions indicated below.

In particular, the first electrically insulating substrate 13 can conveniently have a substantially rectangular or square shape in plan (i.e. parallel to the ground plane 12) with lateral dimensions in the order of a few millimeters. Preferably, said first electrically insulating substrate 13 can have, parallel to the longitudinal reference direction z, a length that is equal to or greater than 4 mm. Furthermore, said first electrically insulating substrate 13 can conveniently have a thickness (parallel to the vertical reference direction y) of between 200 μm and 1 mm, preferably, in order to make the triode 11 operate at THz frequencies, between 200 μm and 500 μm.

The offset, or rather the vertical distance (i.e. parallel to the vertical reference direction y), between the recessed top surface 13*b* and the raised top surface 13*c* of the first electrically insulating substrate 13 can conveniently be between 0.5 μm and a few tens of microns, in particular between 0.5 μm and 15 μm. Preferably, in order to make the triode 11 operate at THz frequencies, said offset should be between 0.5 μm and 5 μm.

The thickness (parallel to the vertical reference direction y) of the cathode electrode 14 and gate electrode 15 can be between 50 nm and 300 nm. Preferably, in order to make the triode 11 operate at THz frequencies, said thickness of the cathode electrode 14 and gate electrode 15 can be between 50 nm and 100 nm.

The cathode fingers 14*b* and gate fingers 15*b* can conveniently have, parallel to the transversal reference direction x, a width between a minimum of a hundred nanometers and a maximum of a few micron, according to the manufacturing technology employed (optical or e-beam photolithography). Preferably, said width of the cathode fingers 14*b* and gate fingers 15*b* can be between 0.1 μm and 20 μm. In order to make the triode 11 operate at THz frequencies, said width of the cathode fingers 14*b* and gate fingers 15*b* can conveniently be between 0.1 μm and 1 μm.

Each cathode finger 14*b* can be conveniently spaced apart laterally (or rather, parallel to the transversal reference direction x) from the corresponding first raised areas 13*f*, between which said cathode finger 14*b* is contained (i.e. from the corresponding gate fingers 15*b* that are immediately adjacent to said cathode finger 14*b*), by a distance of between 0.3 μm and 20 μm, preferably, in order to make the triode 11 operate at THz frequencies, between 0.3 μm and 3 μm.

The number of cathode fingers 14*b* and gate fingers 15*b* can be conveniently comprised between a minimum of a few units and a maximum of a few tens.

The cathode conduction line 14*e* and gate conduction line 15*d* can conveniently have, parallel to the transversal reference direction x, a width of between 20 μm and 1020 μm, preferably, in order to make the triode 11 operate at THz frequencies, between 20 μm and 100 μm, so as to be able to connect the triode 11 externally by wire bonding.

The active region 11*a* can conveniently have, parallel to the longitudinal reference direction z, a length of between 20 μm and 500 μm, preferably, in order to make the triode 11 operate at THz frequencies, between 20 μm and 100 μm.

The electron emitters 14*c* can conveniently have, parallel to the vertical reference direction y, a height substantially equal to the height of the dielectric between the cathode fingers 14*b* and gate fingers 15*b*, so as to optimize the transconductance of the triode 11 as much as possible.

The second electrically insulating substrate 16 can conveniently have a substantially rectangular or square shape in plan (i.e. parallel to the ground plane 12) with lateral dimensions substantially equal to those of the first electrically insulating substrate 13. In addition, the thickness (parallel to the vertical reference direction y) of said second electrically insulating substrate 16 can conveniently be in the order of a few hundreds of microns, so as to be able to use extraction voltages that are not too high. Preferably, the thickness of said second electrically insulating substrate 16 can be between 100 μm and 500 μm. In order to make the triode 11 operate at THz frequencies, the thickness of said second electrically insulating substrate 16 can conveniently be between 100 μm and 300 μm.

The third recess 16*b* can conveniently have a substantially rectangular or square shape in plan (i.e. parallel to the ground plane 12) with lateral dimensions having respective values between a minimum of a few hundred microns and a maximum of a few millimeters. Preferably, the third recess 16*b* can have, parallel to the longitudinal reference direction z, a length of between 0.5 mm and 2 mm. In order to make the triode 11 operate at THz frequencies, the third recess 16*b* can conveniently have, parallel to the longitudinal reference direction z, a length of between 0.3 mm and 1.5 mm.

The anode terminal 17*a* can conveniently have a substantially rectangular or square shape in plan (i.e. parallel to the ground plane 12) with lateral dimensions having respective values between a minimum of 0.5 mm and a maximum of a few millimeters.

The following table concisely lists the values of characteristic impedance $Z_0$ and propagation loss $\alpha$ for the cathode conduction line 14*e* and gate conduction line 15*d* that correspond to different widths W (parallel to the transversal reference direction x) of said cathode conduction line 14*e* and gate conduction line 15*d* and to different thicknesses H (parallel to the vertical reference direction y) of the first electrically insulating substrate 13, under the assumption that said first electrically insulating substrate 13 has a relative electric permittivity (or relative dielectric constant) $\in_r$ equal to 4 and that said cathode conduction line 14*e* and gate conduction line 15*d* have a thickness T (parallel to the vertical reference direction y) equal to 300 nm.

TABLE

| W (μm) | H (μm) | T (nm) | $Z_0$ (Ω) | $\epsilon_r$ | α (dB/mm) |
|---|---|---|---|---|---|
| 612 | 300 | 300 | 50 | 4 | $4.2 \cdot 10^{-3}$ |
| 1020 | 500 | 300 | 50 | 4 | $5.6 \cdot 10^{-3}$ |
| 20 | 500 | 300 | 194 | 4 | $3.5 \cdot 10^{-2}$ |

The first electrically insulating substrate 13 and the second electrically insulating substrate 16 can be conveniently made using initial substrates in Pyrex glass, or fused silica, or float glass, or quartz.

The advantages of the first preferred embodiment of the present invention can be immediately appreciated from the foregoing description.

In particular, it is important to underline yet again the fact that the cathode electrode 14 and gate electrode 15 do not overlap in any region of the triode 11 and that, specifically, the cathode fingers 14*b* and gate fingers 15*b* are interlaced, and therefore not overlapped, in the active region 11*a*. This feature of the triode 11 enables parasitic capacitances between the cathode electrode 14 and gate electrode 15 to be significantly reduced or even completely eliminated and genuinely extends the operating frequency band of the triode 11 into the THz range.

Furthermore, unlike, for example, the angular structure of the electron source described in EP 2 113 934 A2, which, as previously described, severely limits the operating frequencies of said electron source, the geometry of the cathode electrode 14 and the gate electrode 15, in particular thanks to the cathode straight-finger-shaped terminals 14*b*, the gate straight-finger-shaped terminals 15*b*, the straight cathode conduction line 14*e* and the straight gate conduction line 15*d*, enables the operating frequency band of the triode 11 to be genuinely extended to the THz range.

Furthermore, because the anode electrode 17 is only partially overlapping the cathode electrode 14 and gate electrode 15 (in particular, only the anode terminal 17*a* fully overlaps the cathode fingers 14*b*, gate fingers 15*b*, cathode backbone line 14*d* and gate backbone line 15*c* and just partially overlaps the cathode conduction line 14*e* and gate conduction line 15*d*), parasitic capacitances between the anode electrode 17 and the cathode electrode 14 and gate electrode 15 are also significantly reduced.

On the other hand, thanks to the fact that the cathode conduction line 14*e* and gate conduction line 15*d* have respective main extension directions that (if projected on any reference plane parallel to the ground plane 12) form an angle of 180° between them and the fact that the anode conduction line 17*b* has a main extension direction that forms a respective 90° angle with each of the main extension directions of the cathode conduction line 14*e* and gate conduction line 15*d* (if said directions are projected on any reference plane parallel to the ground plane 12), a reduction is also obtained in any coupling of the high-frequency signals between the various electrodes.

Finally, the geometry of the cathode 14, gate 15 and anode 17 electrodes makes the manufacturing process of these electrodes extremely simple and easily reproducible.

A second preferred embodiment of the present invention relates to an electron gun with a cold-cathode electron emitter.

Figure 10:
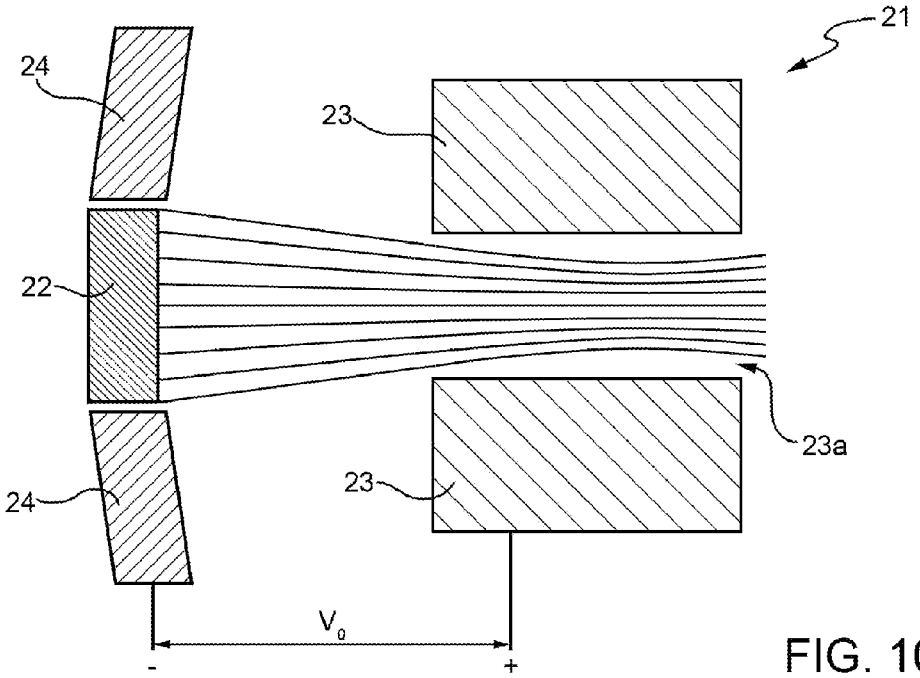
FIG. 10 shows a schematic cross-sectional view of an electron gun with a cold-cathode electron emitter according to a second preferred embodiment of the present invention.

Regarding this, FIG. 10 (where the dimensions shown are not to scale for simplicity of illustration) shows a schematic cross-sectional view of a cold-cathode electron gun 21 according to said second preferred embodiment of the present invention.

In particular, the cold-cathode electron gun 21 comprises:

- an active part 22 designed to emit a modulated electron beam;
- an anode structure 23 spaced apart from the active part 22 and comprising a hole 23*a* that passes completely through it and that faces, at a first end, onto the active part 22 and, at a second end, onto a collector (not shown in FIG. 10 for simplicity of illustration); and
- a focusing grid 24, which is placed around the active part 22 and is designed to focus the modulated electron beam emitted by the active part 22 towards the first end of the hole 23*a* of the anode structure 23.

In detail, the anode structure 23 is designed to further accelerate and focus the electron beam that passes through the hole 23*a*, by means of a large potential difference $V_0$ with respect to the focusing grid 24, and the collector is designed to receive the flow of electrons that that exits from the second end of the hole 23*a* of the anode structure 23.

In greater detail, the active part 22, although shown very schematically in FIG. 10 for simplicity of illustration, comprises:

- the previously described electrically conductive layer 12;
- the previously described first electrically insulating substrate 13;
- the previously described cathode electrode 14; and
- the previously described gate electrode (or control grid or modulation grid) 15.

As previously described, the cathode electrode 14 comprises the cathode multi-fingered structure 14*a*, which is designed to emit electrons via the electron emitters 14*c*, and the gate electrode 15 comprises the gate multi-fingered structure 15*a*, which is designed to modulate the electron beam emitted by the electron emitters 14*c*, is offset with respect to the cathode multi-fingered structure 14*a* (the cathode electrode 14 and gate electrode 15 actually lie on different planes) and is interlaced with said cathode multi-fingered structure 14*a*.

Thanks to the use of the cathode multi-fingered structure 14*a* and the gate multi-fingered structure 15*a* in the electron gun 21, it is possible to directly modulate the emitted current by applying an RF signal on the gate electrode 15.

In particular, the use of the cathode multi-fingered structure 14*a* and the gate multi-fingered structure 15*a* ensures that the electron gun 21 can operate at THz frequencies, thereby overcoming the operating frequency limits of known cold-cathode electron guns, such as, for example, that described in *Experimental Demonstration of an Emission-Gated Traveling-Wave Tube Amplifier.*

The electron gun 21 can be usefully exploited to produce vacuum amplifiers, such as, for example, TWT and Klystron amplifiers, operating at THz frequencies.

However, it is wished to underline the fact that the cold-cathode electron gun 21 has the same technical advantages of the triode 11 that have been described in the foregoing.

Finally, it is clear that various modifications can be applied to the present invention without leaving the scope of protection of the invention defined in the appended claims.

The invention claimed is:

1. An electron-emitting cold cathode device, comprising:

a cathode electrode that lies on a cathode plane and includes, in an active region, a cathode fingered structure comprising one or more cathode straight-finger-shaped terminals, each with a respective main extension direction substantially parallel to a first reference direction;

for each cathode straight-finger-shaped terminal, one or more respective electron emitters formed on, and in ohmic contact with, the cathode straight-finger-shaped terminal, each electron emitter having a respective main extension direction substantially perpendicular to the cathode plane; and a gate electrode that lies on a gate plane substantially parallel to, and spaced apart from, the cathode plane, does not overlap the cathode electrode and includes, in the active region, a gate fingered structure comprising two or more gate straight-finger-shaped terminals, each with a respective main extension direction substantially parallel to the first reference direction, the two or more gate straight-finger-shaped terminals being interlaced with the one or more cathode straight-finger-shaped terminals and are designed to modulate an electron beam emitted, in use, by the one or more respective electron emitters.

2. The electron-emitting cold cathode device of claim 1, wherein:

the cathode electrode further comprises a cathode conduction line that is connected to the cathode fingered structure, has a straight-strip-like shape with a main extension direction substantially parallel to the first reference direction, and is substantially symmetrical with respect to an axis of symmetry of the cathode parallel to the first reference direction;

the cathode fingered structure is substantially symmetrical with respect to the axis of symmetry of the cathode;

the gate electrode further comprises a gate conduction line that is connected to the gate fingered structure, has a straight-strip-like shape with a main extension direction substantially parallel to the first reference direction, and is symmetrical with respect to an axis of symmetry of the gate parallel to the first reference direction; and the gate fingered structure is substantially symmetrical with respect to the axis of symmetry of the gate.

3. The electron-emitting cold cathode device of claim 2, wherein the cathode electrode further comprises a cathode backbone line that:

has a straight-strip-like shape with a main extension direction that is substantially parallel to a second reference direction substantially orthogonal to the first reference direction;

is substantially symmetrical with respect to the axis of symmetry of the cathode; and is interposed between the cathode fingered structure and the cathode conduction line so as to connect the cathode conduction line to the cathode fingered structure; and wherein the gate electrode further comprises a gate backbone line that:

has a straight-strip-like shape with a main extension direction substantially parallel to the second reference direction;

is substantially symmetrical with respect to the axis of symmetry of the gate; and is interposed between the gate fingered structure and the gate conduction line so as to connect the gate conduction line to the gate fingered structure.

4. The electron-emitting cold cathode device of claim 3, wherein:

the cathode fingered structure extends laterally from the cathode backbone line;

the cathode conduction line extends laterally from the cathode backbone line on the opposite side with respect to that from which the cathode fingered structure extends;

the gate fingered structure extends laterally from the gate backbone line; and the gate conduction line extends laterally from the gate backbone line on the opposite side with respect to that from which the gate fingered structure extends.

5. The electron-emitting cold cathode device of claim 2, wherein:

the cathode fingered structure extends directly from the cathode conduction line so as to be directly connected to the latter; and the gate fingered structure extends directly from the gate conduction line so as to be directly connected to the latter.

6. The electron-emitting cold cathode device according to claim 1, wherein, for each cathode straight-finger-shaped terminal, the one or more respective electron emitters are median with respect to the cathode straight-finger-shaped terminal.

7. The electron-emitting cold cathode device of claim 6, wherein each cathode straight-finger-shaped terminal is contained between two of the two or more gate straight-finger-shaped terminals; and wherein, for each cathode straight-finger-shaped terminal, the one or more respective electron emitters are also median with respect to the two adjacent gate straight-finger-shaped terminals of the two or more gate straight-finger-shaped terminals.

8. The electron-emitting cold cathode device according to claim 1, further comprising:

an electrically conductive layer designed to operate as a ground plane of the device, the cathode and gate planes being substantially parallel to the ground plane; and a first electrically insulating substrate arranged on the electrically conductive layer, the cathode and gate electrodes being formed on the first electrically insulating substrate.

9. The electron-emitting cold cathode device of claim 8, wherein:

the first electrically insulating substrate includes two offset top surfaces that are substantially parallel to the ground plane and includes a first top surface and a second top surface, wherein the first top surface is lowered with respect to the second top surface;

the cathode electrode is formed on the first electrically insulating substrate so as to partially cover the first top surface thereof; and the gate electrode is formed on the first electrically insulating substrate so as to partially cover the second top surface thereof.

10. The electron-emitting cold cathode device of claim 9, wherein:

the first top surface of the first electrically insulating substrate includes one or more recessed areas formed on the active region and each having a respective straight-finger-like shape with a respective main extension direction parallel to the first reference direction;

each cathode straight-finger-shaped terminal is formed on a respective one of the one or more recessed areas;

the second top surface of the first electrically insulating substrate comprises two or more raised areas formed at the active region and each having a respective straight-finger-like shape with a respective main extension direction substantially parallel to the first reference direction;

the two or more raised areas are interlaced with the one or more recessed areas; and the gate straight-finger-shaped terminals are each formed on a respective first raised area in a manner such that they are interlaced with the one or more cathode straight-finger-shaped terminals.

11. The electron-emitting cold cathode device according to claim 1, further comprising an anode electrode that:

lies on an anode plane substantially parallel to and spaced apart from the cathode and gate planes;

is arranged so that the gate electrode is interposed between the cathode and anode electrodes; and includes an anode terminal placed over, and facing onto, the active region so as to receive, in use, the electron beam emitted by the one or more respective electron emitters and modulated by the two or more gate straight-finger-shaped terminals, such that the electron-emitting cold cathode device is configured to operate as a triode.

12. The electron-emitting cold cathode device of claim 11, further comprising:

an electrically conductive layer designed to operate as a ground plane of the electron-emitting cold cathode device; the cathode, gate and anode planes being substantially parallel to the ground plane;

a first electrically insulating substrate arranged on the electrically conductive layer, the cathode electrode and gate electrode being formed on the first electrically insulating substrate; and a second electrically insulating substrate, which includes a first recess formed on a lower surface of the second electrically insulating substrate, the first recess having a main extension direction substantially parallel to the first reference direction; the second electrically insulating substrate further including a second recess that passes through the second electrically insulating substrate, starting from a top surface of the second electrically insulating substrate and reaching the first recess, and which has a main extension direction substantially orthogonal to the ground plane; the second electrically insulating substrate being bonded onto the first electrically insulating substrate so that the first recess opens onto top portions of the first electrically insulating substrate on which the cathode electrode and gate electrode are formed and so that the second recess opens onto the active region;

wherein the anode electrode is formed on the second electrically insulating substrate so as to partially cover the top surface thereof; and wherein the anode terminal closes the top of the second recess.

13. The electron-emitting cold cathode device according to claim 11, wherein the anode electrode further comprises an anode conduction line that:

is connected to the anode terminal;

extends laterally from the anode terminal; and has a straight-strip-like shape with a main extension direction that is substantially parallel to a second reference direction substantially orthogonal to the first reference direction.

14. The electron-emitting cold cathode device according to claim 1, further comprising an anode structure that:

is spaced apart from the cathode electrode and the gate electrode;

is arranged so that the gate electrode is interposed between the cathode electrode and the anode structure;

comprises a hole that passes completely through the anode structure and faces, at a first end, the active region so as to receive, in use, the electron beam emitted by the one or more respective electron emitters and modulated by the two or more gate straight-finger-shaped terminals; and is designed to accelerate and focus the electron beam that, in use, passes through the hole such that the electron-emitting cold cathode device is configured to operate as an electron gun.

15. The electron-emitting cold cathode device of claim 14, further comprising:

a focusing grid designed to focus towards the first end of the hole of the anode structure the electron beam, in use, emitted by the one or more respective electron emitters and modulated by the two or more gate straight-finger-shaped terminals; and a collector facing a second end of the hole of the anode structure so as to receive, in use, the electron beam that exits from the second end of the hole of the anode structure.

* * * * *